US005310579A

United States Patent [19]

Fornataro

[11] Patent Number: 5,310,579

[45] Date of Patent: May 10, 1994

[54] METHOD AND APPARATUS FOR PAINTING A SURFACE BY MOVING A DEVICE THROUGH A PAINT RESERVOIR AND ACROSS THE SURFACE

[75] Inventor: Mark A. Fornataro, Houston, Tex.

[73] Assignee: Creative Time, Inc., Houston, Tex.

[21] Appl. No.: 991,470

[22] Filed: Dec. 16, 1992

[51] Int. Cl.[5] ..... B05D 3/12

[52] U.S. Cl. ..... 427/290; 273/109; 273/115; 118/211; 118/213; 118/216; 118/225; 118/263; 118/505; 427/282; 427/288

[58] Field of Search ..... 427/280, 282, 288, 290; 118/211, 213, 216, 221, 225, 255, 263, 505; 273/109, 110, 111, 113, 115, 441

[56] References Cited

U.S. PATENT DOCUMENTS 3,674,271 7/1972 De Gelder et al. ..... 273/115

*Primary Examiner*—Terry J. Owens

*Attorney, Agent, or Firm*—J. M. Gilbreth

[57] ABSTRACT

Apparatus and method for painting an object. The object is affixed to a holder and a reservoir of paint is formed either on or adjacent to the surface of the object. The holder then is tilted sufficiently to cause a paint distribution device, such as a sphere or spinning top, to travel through the pain and across the surface of the object, leaving paint along the travel path of the paint distribution device.

16 Claims, 2 Drawing Sheets

FIG. 1
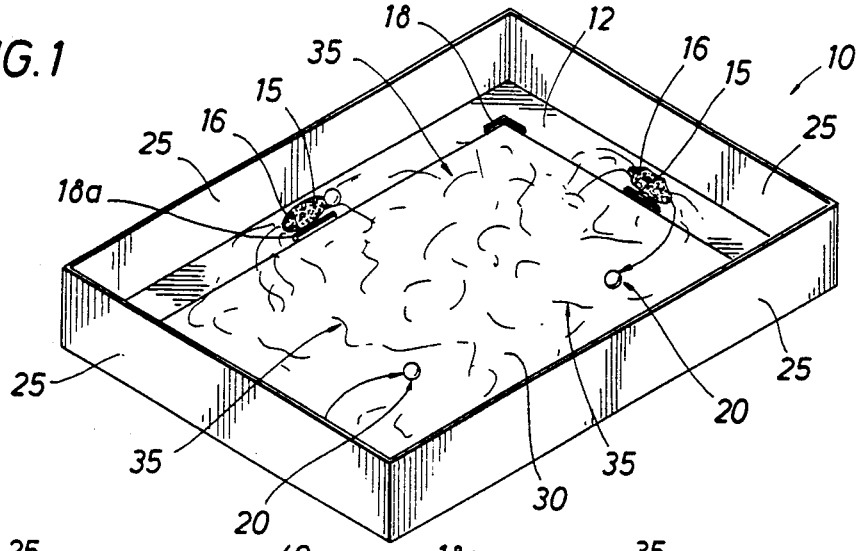
FIG. 2
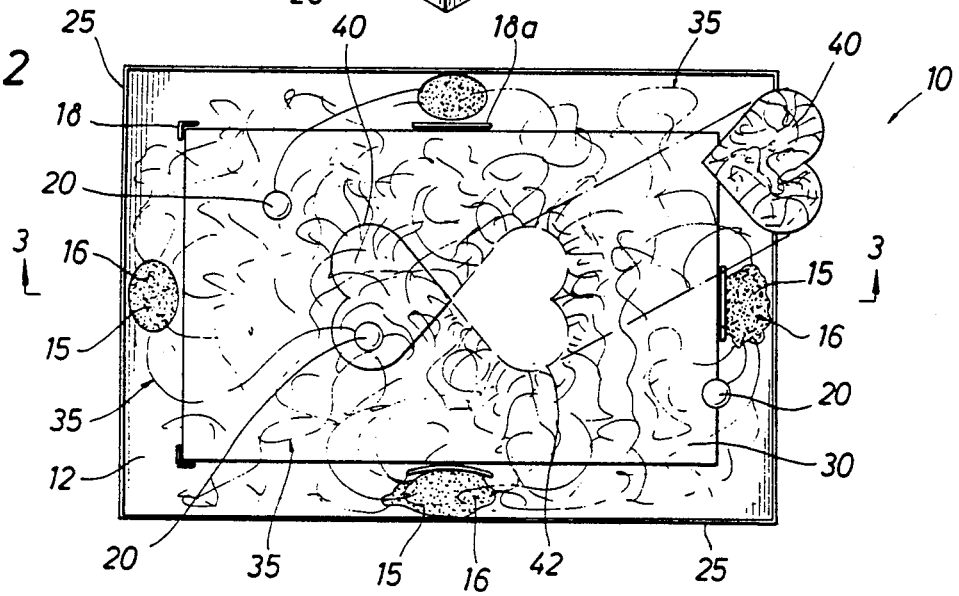
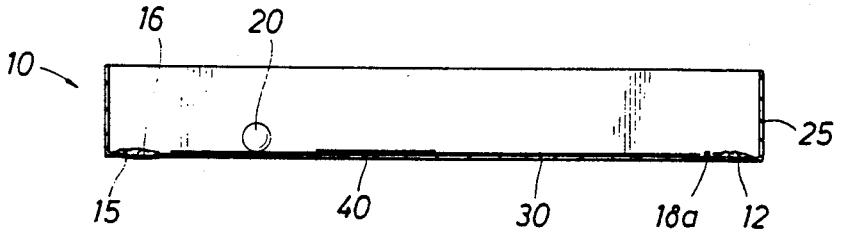
FIG. 3
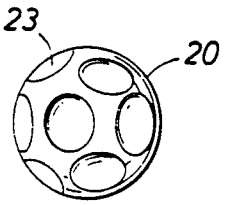
FIG. 4
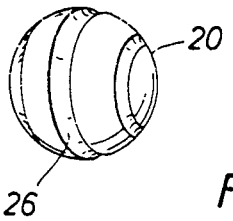
FIG. 5

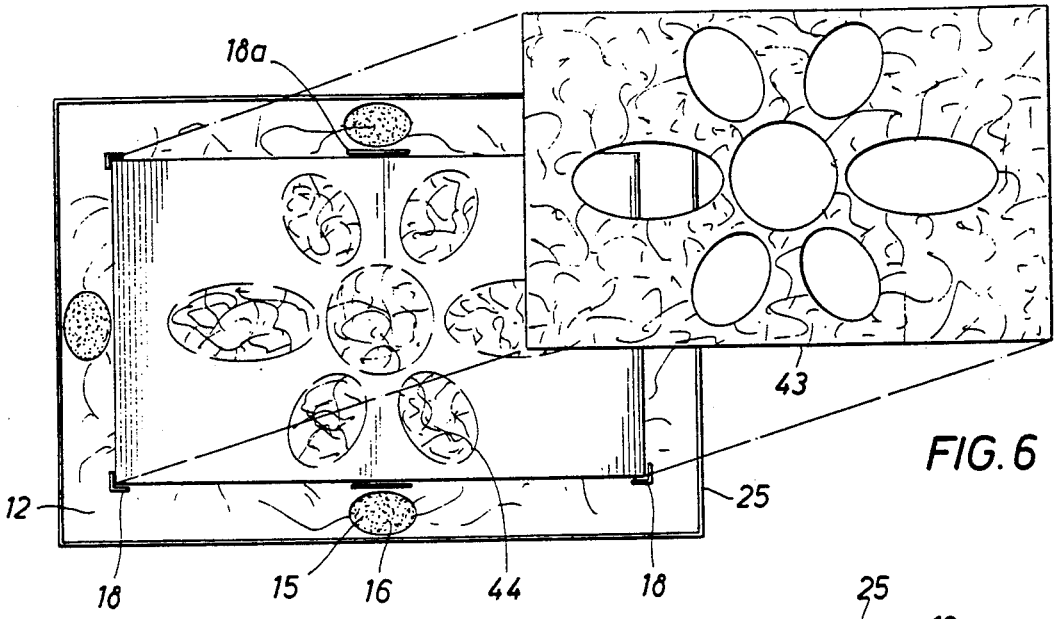
FIG. 6
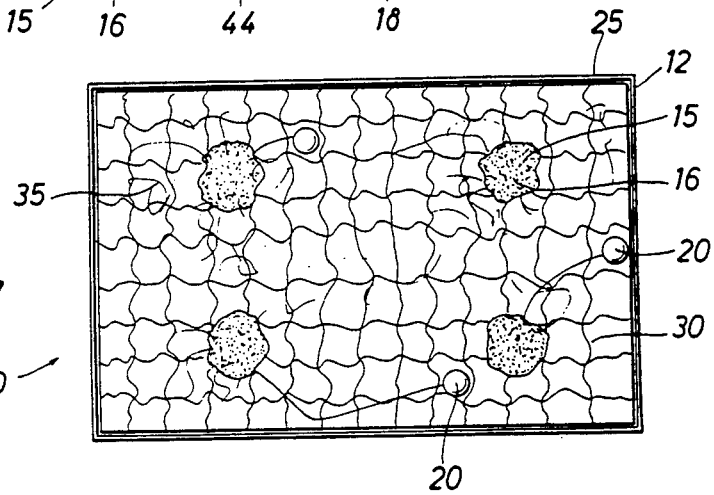
FIG. 7
FIG. 8
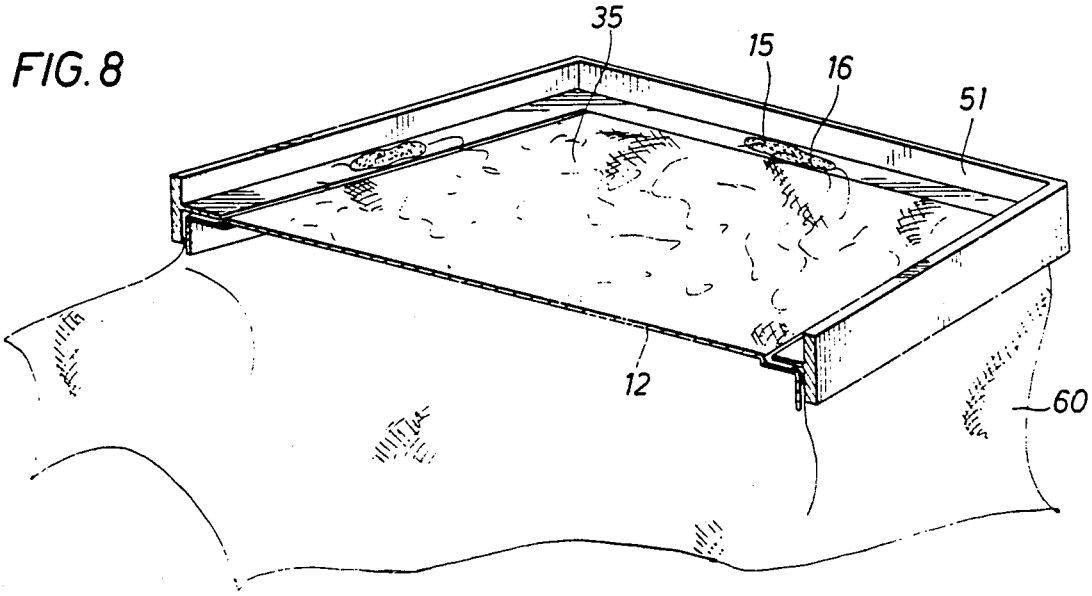

METHOD AND APPARATUS FOR PAINTING A SURFACE BY MOVING A DEVICE THROUGH A PAINT RESERVOIR AND ACROSS THE SURFACE

BACKGROUND OF THE INVENTION

1. Field of the Invention

The present invention relates to a method and apparatus for applying a medium to an object. In another aspect, the present invention relates to a method and apparatus for applying paint to an object. In still another aspect, the present invention relates to a method and apparatus for painting utilizing rolling objects, such a marbles, which are rolled through puddles of paint, leaving a paint trail along the marble travel path.

2. Brief Description of the Related Art

Methods and apparatus for applying paint to surfaces are well known. The most common of these include brushes and spraying. For children (and many adults) artistic endeavors utilizing such traditional methods of painting can be challenging.

Accordingly, there exists a need for a method and apparatus of creating an artistic work more suitable to the talents and motor skills of children (and many adults). There also exists a need for a method and apparatus for creating an artistic work that is fun and entertaining for children and adults alike.

It is therefore an object of the present invention to provide a method and apparatus for creating artistic paintings that is easy to operate.

It is an other object of the present invention to provide for a method and apparatus for creating an artistic work that is fun and entertaining to operate.

These and other objects will become readily apparent from the following disclosure.

SUMMARY OF THE INVENTION

According to one embodiment of the present invention there is provided an apparatus for applying paint to an object, such as paper, canvas, cardboard, plastic, glass or cloth. This apparatus includes a painting surface upon which the object to be painted is placed. The apparatus also includes holder means attached to the painting surface for securing the object to the painting surface. The apparatus further includes paint reservoir means attached to the painting surface for storing paint adapted to receive a paint distribution means. Finally, the apparatus includes a paint distribution means, adapted to roll across the object and through the paint reservoir means as the painting surface is tilted and further distribute paint from the paint reservoir means along the roll path of the paint distribution means.

According to another embodiment of the present invention there is provided a method for applying paint to the surface of an object. This method generally includes affixing the object to be painted to a holder. Next, a reservoir of paint is formed on holder, generally in a puddle. Finally, the holder is tilted is a manner sufficient to force a paint distribution device to roll through the paint reservoir and across the surface of the object to distribute paint along the roll path of the paint distribution device.

According to still another embodiment of the present invention there is provided a method for applying paint to the surface of an object to be painted. This method includes first affixing the object to a holder. Next, a reservoir of paint is formed on the surface of the object to be painted, generally in a puddle. Finally, the holder is tilted in a manner sufficient to force a paint distribution device to roll through the paint reservoir and across the surface of the object to distribute paint along the roll path of the paint distribution device.

BRIEF DESCRIPTION OF THE DRAWINGS

FIG. 1 illustrates one embodiment of the apparatus of the present invention, showing paint kit 10 which includes painting surface 12, paint reservoirs 15, holders 18, paint distribution devices 20 and retaining walls 25.

FIG. 2 is a drawing of one embodiment of the apparatus of the present invention showing paint kit 10 which includes painting surface 12, paint reservoirs 15, holders 18, paint distribution devices 20, retaining walls 25, and heart shaped pattern 40.

FIG. 3 is a cross-sectional view of paint kit 10 of FIG. 2 at 3—3.

FIG. 4 shows an embodiment of spherical paint distribution device 20 with dimples 23.

FIG. 5 shows an embodiment of spherical paint distribution device 20 with grooves 26.

FIG. 6 illustrates an embodiment of the present invention, showing paint kit 10 which includes painting surface 12, paint reservoirs 15, holders 18, paint distribution devices 20, retaining walls 25, and template 43.

FIG. 7 shows an embodiment of the present invention, with paint reservoirs 15 shown directly on object 30, which is a precut jig-saw puzzle.

FIG. 8 shows an embodiment of the present invention in which cloth 60 is secured by brackets 51 to painting surface 12 and painted by the painting method of the present invention.

DETAILED DESCRIPTION OF THE INVENTION

The present invention will now be described by reference to FIGS. 1–8. FIG. 1 shows one embodiment of the apparatus of the present invention, showing paint kit 10. While paint kit 10 is shown generally box shaped it is understood that any suitable geometric shape may be utilized. Paint kit 10 includes painting surface 12, paint reservoirs 15, holders 18, paint distribution devices 20 and retaining walls 25.

In the embodiment shown, painting surface 12 is rectangular shaped and flat. It is understood however, that painting surface 12 may be of any desired shape and does not necessarily need to be flat. Upon painting surface 12 is affixed object 30 to be painted. In the embodiment shown object 30 is a sheet of paper. Suitable alternatives for object 30 include canvas, cardboard, wood, cloth, glass, plastic or any other material to which paint may be adhered. Preferably, object 30 is paper or cardboard. Most preferably, object 30 is paper.

Object 30 is affixed to painting surface 12 by holders 18 at each corner. Alternatively, holders **18*a* may be positioned along each side of object 30. Holders 18*a* would also serve to keep paint 15 from flowing onto paper 30. While both are shown in the figure, it is understood that only one set of holders is necessary. Preferably, holders 30 are L shaped corner brackets which securely affix paper 30 in place on painting surface 12. It is noted that it is only necessary to secure object 30 to painting surface 12 so that it will not move along painting surface 12 during the medium application process. It is generally not necessary to secure object 30 against vertical movement away from painting surface 12 because the weight of object 30 and the medium application devices 20 will generally keep object 30 on painting surface 12. Thus, for example, as will be shown in a later embodiment, a retaining wall or framing around object 30, will serve to properly affix object 30 on painting surface 12**.

Paint distribution devices 20 may be any suitable shape capable of travelling across object 30 and distributing paint along its travel path. For example, paint distribution devices 20 may be any suitable device that will roll, slide, glide, tumble, or otherwise travel through reservoirs 15 and distribute paint along its travel path. In the embodiment shown, paint distribution devices are spheres. Examples of other suitable shapes include cylinders, cones, ovals and dumbbells. The surfaces of these shapes may be smooth and regular or may be irregular and include dimples or grooves. For example, FIGS. 4 and 5 show spherical paint distribution devices 20 with dimples 23 and grooves 26, respectively. The surfaces of paint distribution devices 20 may also be textured. The present invention requires the use of at least one paint distribution device 20, with generally two or more being utilized. A spinning top may also be utilized as paint distribution device 20.

Paint reservoir 15 may be any suitable structure that is capable of serving as a paint reservoir and that will allow paint distribution device 20 to roll or travel into reservoir 15, contact the paint 16 in reservoir 15, and roll or travel out of reservoir 15 to distribute paint 16 along its roll or travel path 35 as it travels across object 30. In the present invention, at least one paint reservoir 15 is utilized. Generally, three paint reservoirs 15, into which the primary colors are placed, are utilized. Paint reservoirs 15 are typically general areas on painting surface 12 onto which paint 16 is placed. Alternatively, as in the embodiment shown, paint reservoirs 15 may also comprise slight indentations in painting surface 12 into which paint is placed.

While paint is disclosed as being utilized in the present invention, it is understood that other types of medium such as ink, oil paint, water colors, food coloring, dyes and the like may be utilized. Any type of medium that will leave the desired trail on object 30 may be utilized. Since it is anticipated that children will be utilizing the present invention, preferably, the paint utilized is non-toxic and edible.

Retaining walls 25 serve to contain paint distribution devices 20 during the painting process. Retaining walls 25 generally surround the perimeter of painting surface 12 and serve to prevent paint distribution devices 20 from leaving painting surface 12.

In operation, paper 30 is affixed to painting surface 12 by brackets 18. Paint 16 is placed into paint reservoirs 15. One or more paint distribution devices 20 are then moved through the paint 16 in paint reservoirs 15 and back onto paper 30 by tilting painting surface 12. Proper tilting of painting surface 12 causes spheres 20 to roll through paint 16 in reservoirs 15 and back onto paper 30, distributing paint 16 along the roll path 35 of spheres 20. Once the user has determined that paper 30 is suitably painted, the tilting is ceased, spheres 20 are removed, and paper 30 is removed from painting surface 12.

In an alternate process, paint 16 may be applied directly to the surface of object 30. In such an instance, the paint reservoirs 15 are located on the surface of object 30 and the paint is distributed from there.

FIG. 2 shows another embodiment of the present invention. Again, paint kit 10 which includes painting surface 12, paint reservoirs 15, holders 18, paint distribution devices 20 and retaining walls 25, are shown. Also shown, is pattern 40, which is placed over the surface of object 30 prior to painting. The removal of pattern 40 after painting reveals the shape 42 of pattern 40 on the surface of object 30. In the embodiment shown, shape 42 is a heart shape. Of course, shape 42 may be any shape desired by the user and could include letters.

FIG. 3 is a cross-sectional view of FIG. 2 showing paint kit 10, which includes painting surface 12, paint reservoirs 15, holders 18*a*, paint distribution devices 20, retaining walls 25 and pattern 40.

FIG. 6 shows still another embodiment of the present invention. Again, paint kit 10 which includes painting surface 12, paint reservoirs 15, holders 18, paint distribution devices 20 and retaining walls 25, are shown. Also shown, is template 43, which is placed over the surface of object 30 prior to painting. The removal of template 43 after painting reveals the shape 44 of template 43 on the surface of object 30.

FIG. 7 shows still yet another embodiment of the present invention. Again, paint kit 10 is essentially an open topped box. Object 30 is placed on the bottom of the box which functions as painting surface 12. In this embodiment, paint reservoirs 15 are shown directly on object 30 as discussed above. In addition, object 30 and painting surface 12 are essentially the same size and shape with the sides of the box functioning both as retaining walls 25 and functioning as holders 18 to affix object 30 during painting. In this instance, object 30 is a precut jig-saw puzzle having a multiplicity of interlocking members. After the painting operation is complete, the final product is a jig-saw puzzle with paint travel lines 35 on its surface.

FIG. 8 shows how the present invention may be utilized to paint cloth and other material. The cloth 60 is draped over painting surface 12. Bracket 51 having paint reservoirs 15 containing paint 16 is attached over cloth 60 and painting surface 12 affixing cloth 60 in place.

Proper tilting of painting surface 12 causes painting distribution devices to roll through paint 16 in reservoirs 15 and back onto cloth 60, distributing paint 16 along the roll path 35 of the spheres. Once the user has determined that cloth 60 is suitably painted, the tilting is ceased and the spheres are removed. The cloth is then freed from bracket 51 and painting surface 12 by releasing bracket 51.

The description given herein is intended to illustrate the preferred embodiments of the present invention. It is possible for one of ordinary skill in the art to make various changes to the details of the present invention, including changes in the size, shape and materials, as well as in the details of the illustrated construction without departing from the spirit of this invention. Therefore, it is intended that all such variations be included within the scope of the present invention as claimed.

I claim:

1. An apparatus for applying a medium to an object wherein the medium is selected from the group consisting of paint, ink, dyes and colorings, the apparatus comprising;

(a) an application surface upon which the object is placed;

(b) holder means attached to the application surface for securing the object in place on the application surface;

(c) medium reservoir means attached to the application surface for storing the medium and adapted to receive a medium distribution means; and (d) medium distribution means adapted to travel across the object and through the medium reservoir means as the application surface is tilted to distribute medium from the medium reservoir means along the travel path of the medium distribution means.

2. The apparatus of claim 1 wherein the holder means comprises brackets.

3. The apparatus of claim 1 wherein the medium reservoir means comprises a concave portion defined by the holder means.

4. The apparatus of claim 1 further comprising:

(e) a template for placing on the object.

5. The apparatus of claim 1 further comprising:

(e) a pattern for placing on the object.

6. The apparatus of claim 1 wherein the medium distribution means comprises a sphere.

7. The apparatus of claim 6 wherein the sphere comprises grooves or dimples on its surface.

8. The apparatus of claim 1 wherein the holder means comprises a retaining wall around the perimeter of the application surface suitable to a affix the object in place on the application surface.

9. The apparatus of claim 1 further comprising:

(e) a retaining wall around the perimeter of the application surface suitable for retaining the medium distribution means on the application surface.

10. The apparatus of claim 1 further comprising:

(e) an object to which the medium will be applied, wherein the object comprises a multiplicity of interlocking members.

11. The apparatus of claim 1 wherein the medium distribution means is a spinning top.

12. The apparatus of claim 1 wherein the medium distribution means comprises a sphere and further comprising:

(e) a retaining wall around the perimeter of the application surface suitable for retaining the medium distribution means on the application surface.

13. A method for applying a medium to the surface of an object, wherein the medium is selected from the group consisting of paint, ink, dyes and colorings, the method comprising:

(a) affixing the object to a holder;

(b) forming a reservoir of the medium on the holder; and (c) tilting the holder in a manner sufficient to force a medium distribution device to travel through the medium reservoir and across the surface of the object to distribute the medium along t he travel path of the medium distribution device.

14. The method of claim 13 further comprising first precutting the object to which the medium is to be applied into a multiplicity of interlocking members.

15. A method for applying a medium to the surface of an object, wherein the medium is selected from the group consisting of paint, ink, dyes and colorings, the method comprising:

(a) affixing the object to a holder;

(b) forming a reservoir of the medium on the surface of the object; and (c) tilting the holder in a manner sufficient to force a medium distribution device to travel through the medium reservoir and across the surface of the object to distribute the medium along the travel path of the medium distribution device.

16. The method of claim 15 further comprising first precutting the object to which the medium is to be applied into a multiplicity of interlocking members.

* * * * *